United States Patent [19]

Smirle

[11] 4,087,872

[45] May 9, 1978

[54] MOVABLE BED FRAME

[76] Inventor: James M. Smirle, 309 Windsor Rd., Woodridge, N.J. 07075

[21] Appl. No.: 763,352

[22] Filed: Jan. 28, 1977

[51] Int. Cl.[2] ..... A47C 3/32

[52] U.S. Cl. ..... 5/63; 5/64; 5/328

[58] Field of Search ..... 5/11, 63, 64, 310, 328

[56] References Cited

U.S. PATENT DOCUMENTS

| | | | |
|---|---|---|---|
| 2,592,166 | 4/1952 | McLean et al. | 5/63 |
| 3,628,200 | 12/1971 | Helton | 5/64 |
| 3,676,881 | 7/1972 | Dupkey | 5/63 |

*Primary Examiner*—Casmir A. Nunberg

*Attorney, Agent, or Firm*—Robert D. Farkas

[57] ABSTRACT

A movable bed frame utilizes a fist pair of arms, residing in a common plane, attached to each other at one end thereof by a shaft, pivotably secured to a pair of legs, slidably affixed to a bed frame. A second pair of arms are similarly pivoted and joined together to a pair of bed frame legs located adjacent the headboard end of the frame. The free ends of the arms engage slots located in opposed side members of the frame. Electric motor devices are rotatably coupled to the pair of shafts driving the arms so as to cause the head end or the foot end of the bed frame to move independently of one another relative to a supporting surface for the legs. Means are provided to lower or raise the entire bed frame apparatus by the simultaneous operation of the motors.

6 Claims, 3 Drawing Figures

MOVABLE BED FRAME

BACKGROUND OF THE INVENTION

1. THE FIELD OF THE INVENTION

This invention relates to bed frames and more particularly to that class wherein the frame is selectively positioned to various locations above the supporting surface therebelow.

2. DESCRIPTION OF THE PRIOR ART

The prior art abounds with apparatus for selectively tilting or changing the elevation of bed frame devices. U.S. Pat. No. 3,031,689 issued on May 1, 1962 to W. T. Sark teaches a leveling device comprising a pad affixed to one end of a threaded rod, threadingly engaged within a leg supporting a bed frame for providing a manual adjustment in the leveling and elevation of the bed frame above the surface supporting it.

U.S. Pat. No. 3,795,925 issued on Mar. 12, 1974 to C. J. Leagus Jr. discloses a home-type bed elevating and inclining jack or stand uniquely designed for modern beds embodying a headboard or footboard, angle iron frame types and also Hollywood beds. Two stands, when properly paired and installed, permit such beds to be elevated to assume a moderately inclined plane in a manner to better serve the requirements and medical treatment needs of persons suffering from treatable difficulties. A simplified adaptation for minimal height adjustment, say three inches, more or less, comprises a pedestal embodying a selfstanding base whose upper end is provided with an axial upright. The terminal upper end of the upright is provided with novel notch means capable of seating and retentively holding that part of the bed structure which is cooperable therewith. For adjustment to twelve inches, if desired, extension means for the upright is available.

Both of the aforementioned patents suffer the common deficiency of failing to provide a power driven means to alter the inclination of the bed frame or to alter the elevation of the bed frame above the surface supporting the bed frame.

SUMMARY OF THE INVENTION

A primary object of the present invention is to provide a bed frame which may be tilted at the head end or the foot end thereof relative to a bed frame supporting surface therebelow.

Another object of the present invention is to provide a bed frame whose elevation may be adjusted above the supporting surface.

Still another object of the present invention is to provide a bed frame which may be tilted or elevated in selected amounts utilizing electrically operated devices therefor.

Yet another object of the present invention is to provide a bed frame in accordance with the preceding objects, which is simple in construction, relatively inexpensive and effective for its particular purposes.

Heretofore, bed frame moving or adjusting devices could be divided into two major functional classes. The first class utilized manual adjustment means to dispose the frame in a plane at slected heights above the supporting surface therebelow and/or to dispose the plane skew to the supporting surface. The second class utilized either manual adjustment means or power driven means to alter the angular relationship of selected portions of the surface of the bed frame or mattress supporting elements thereof, to other portions of the surface of the bed frame. Such devices also were utilized to elevate the bed frame, when in the flattened state or contoured state, above the bed frame supporting surface.

The present invention comprises a third class of bed frame moving devices which utilizes electrically operated motors to tilt and change the elevation of an otherwise planar bed frame. The present invention permits either the headboard end or the footboard end of the bed to be independently adjusted in height over the supporting surface and if desired, to change the elevation of the entire planar bed frame either when in a tilted or non-tilted position.

These objects as well as other objects of the present invention will become more readily apparent after reading the following description of the accompanying drawings.

DESCRIPTION OF THE PREFERRED EMBODIMENT

Figure 1:
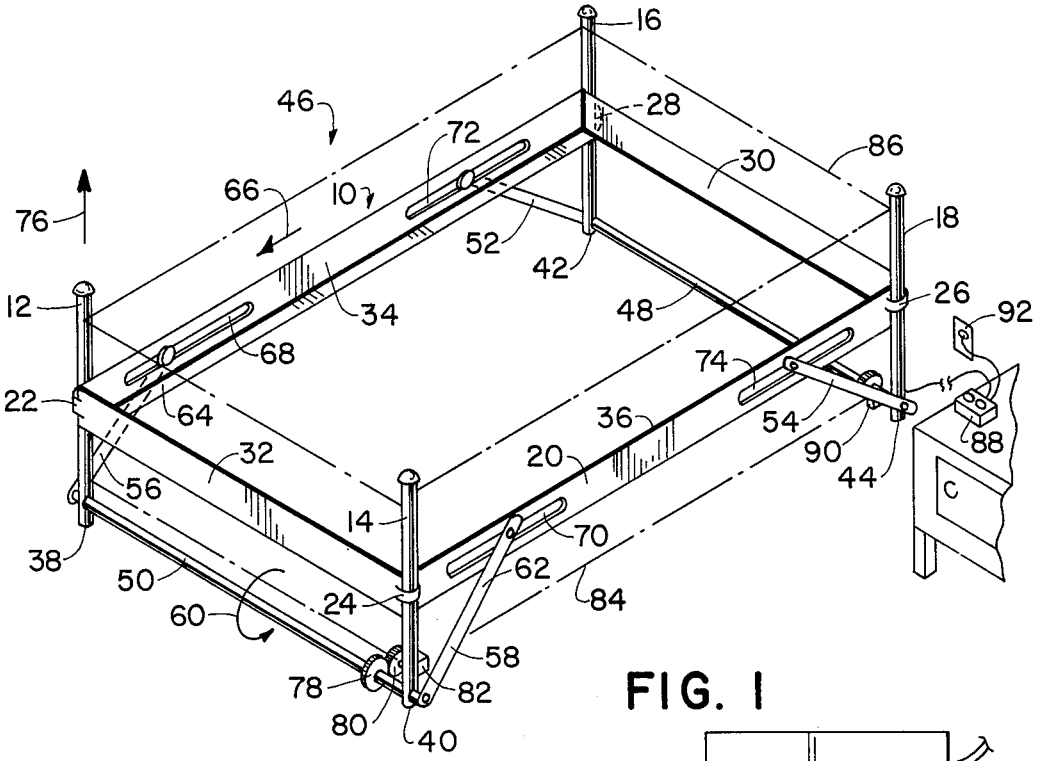
FIG. 1 is a perspective view of the present invention.

The structure and method of fabrication of the present invention is applicable to a rectangular bed frame, comprising a headboard end, a footboard end and a pair of opposed side members, each joined to adjacent frame members so as to form a repository supporting surface for a box spring and mattress combination. A sleeve is affixed to the frame at each corner thereof, having a leg slidably positioned therewithin. The lowermost end of the leg rests upon a supporting surface, having the uppermost end of the leg extending above the frame. The length of the leg is of appropriate size facilitating the range of motion of the frame and the sleeve to which it is attached along the length of the leg. The pair of legs adjacent the footboard end of the frame are provided with holes which are co-axially aligned, running parallel with the footboard end of the frame. A shaft extends through the holes and outwardly of the pair of legs, having one end of a pair of arms fixedly secured to the free ends of the shaft. The pair of arms are disposed in parallel spaced apart relationship defining a plane which is skew to the plane defined by the pair of legs adjacent the footboard end of the bed frame. A pair of slots are located in the opposed side emembers of the bed frame and extend parallel to each other, adjacent the end of the side members of the frame closest to the footboard end of the frame. The other ends of the arms are provided with wheels, pivotably secured thereto having an annular groove extending radially inwardly from the peripheral marginal edges of the wheels. The wheels are located in the slots, having their annular grooves engaging a side wall of the slot.

An electric motor is secured in the lowermost region of one of the legs adjacent the footboard end of the bed frame. A pair of spur gears rotatably couple the output shaft of the motor to the shaft journalled within the pair of legs adjacent the footboard end of the bed frame. When the electric motor is energized, the coupling shaft is caused to rotate, thereby causing the pair of arms to change their angular relationship to the pair of legs to which they are pivotably mounted. The other ends of the arms move along the length of their adjacent slots causing the footboard end of the frame to change its elevation above the bed frame supporting surface, thus tilting the bed frame relative to the supporting surface.

The headboard end of the bed frame is similarly provided with another shaft, another motor and another pair of arms, each having wheels engaged within slots located in opposed side members adjacent the headboard end of the side members. Thus, the headboard end of the apparatus may be changed in elevation above the supporting surface independent of the elevation of the footboard end of the bed frame.

The apparatus is further provided with an independent electrical control for each of the motor drives, which can energize the motors in either direction. If desired, both controls may be ganged together, in conventional fashion, facilitating the joint operation of the motors so as to cause the entire bed frame to alter the elevation above the supporting surface when the bed frame is in a horizontal or a tilted position. The controls may be fabricated from switches, operating the motors at a constant speed, or if desired, may be fabricated from switches in combination with silicone controlled rectifiers which may be utilized to energize the motors at variable speeds.

Now referring to the figures, and more particularly to the embodiment illustrated in FIG. 1 showing the present invention 10. Legs 12, 14, 16 and 18 are provided slidably attached to bed frame 20 utilizing sleeves 22, 24, 26 and 28, respectively. Bed frame 20 comprises headboard member 30, footboard member 32 and opposed side members 34 and 36, attached describing a rectangular shape upon which a box spring and mattress assembly, not shown, may be supported. Ends 38, 40, 42 and 44 of legs 12, 14, 16 and 18, respectively, rest upon supporting surface 46. Shaft 48 is journalled to and passes through opening in legs 12 and 14. Arms 52 and 54 are secured to the free ends of shaft 48. Arms 56 and 58 are secured to the free ends of shaft 50. Thus, when shaft 50 is rotated in the direction of arrow 50, end 62 of arm 58 and end 64 of arm 56 move in the direction of arrow 66. The free ends of arms 56 and 58 are engaged within slots 58 and 70, located in side members 34 and 36, respectively. In likewise fashion, arms 52 and 54 are slidably engaged within slots 72 and 74, respectively. When shaft 50 is rotated in the direction of arrow 60, footboard member 32 is caused to move in tge direction of arrow 76 thereby allowing frame 20 to tilt relative to supporting surface 46. Shaft 50 carries spur gear 78 which engages the teeth of spur gear 80. Spur gear 80 is rotated when motor 82 is energized. Motor 82 is mounted to leg 14 below dotted lines 84, depicting the lowermost possible excursion of frame 20. Dotted lines 86 depict the uppermost excursion of frame 20. Control box 88 controls the operation of motors 82 and 90 and utilizes electrical energy obtained from household utility outlet 92.

Figure 2:
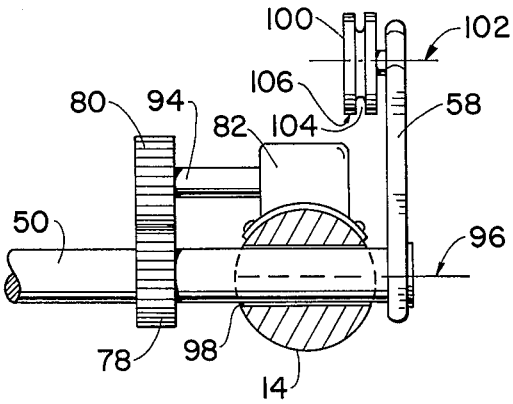
FIG. 2 is a cross-sectional plan view taken through a leg of the present invention, shown in FIG. 1.

FIG. 2 illustrates shaft 50, to which is affixed spur gear 78. Spur gear 80 engages the teeth of spur gear 78, such that when output shaft 94 of motor 82 is caused to rotate, shaft 50 rotates in an opposite direction, thereby causing arm 58 to pivot about the longitudinal axis 96 of shaft 50. Shaft 50 passes through and is journalled with a hole 98 in leg 14. Wheel 100 is rotationally secured to arm 58 along axis 102, and is provided with annular groove 104 extending radially inwardly from the marginal edge 106 of wheel 100. Groove 104 captures the side wall of side member 36 adjacent slot 70.

Figure 3:
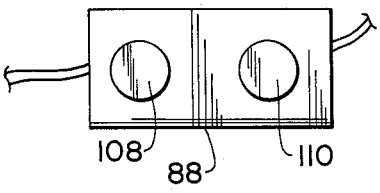
FIG. 3 is a plan view of the control box assembly shown in FIG. 1.

FIG. 3 illustrates control box 88 having control knobs 108 and 110 extending outwardly therefrom. Knobs 108 and 110 may be used to manually operate switches or speed controls, not shown, which in turn independently or concurrently energize motors 82 and 90 in a preferred direction, and if desired, at preferred rates of speed.

One of the advantages of the present invention is a bed frame which may be utilized in a tilted position at the head end or the foot end thereof relative to a bed frame supporting surface therebelow.

Another advantage of the present invention is to provide a bed frame whose elevation may be adjusted above the supporting surface.

Still another advantage of the present invention is to provide a bed frame which may be tilted or elevated in selected amounts utilizing electrically operated devices therefror.

Yet another advantage of the present invention is to provide a bed frame in accordance with the preceding advantages, which is simple in construction, relatively inexpensive and effective for its particular purposes.

Thus, there is disclosed in the above description and in the drawings, an embodiment of the invention which fully and effectively acomplishes the objects thereof. However, it will become apparent to those skilled in the art, how to make variations and modifications to the instant invention. Therefore this invention is to be limited, not by the specific disclosure herein, but only by the appending claims.

The embodiment of the invention in which an exclusive privilege or property is claimed are defined as follows:

I claim:

1. In a bed frame having a pair of legs located at the headboard end of the frame and a pair of legs located at the footboard end of the frame, said pairs of legs for resting on a supporting surface below the frame, the frame having a generally rectangular shape including a pair of opposed elongated side members attached to a headboard end member and a footboard end member, the improvement comprising:

means to slidably attach said pairs of legs to said frame, a first pair of arms, one end of each of said first pair of arms pivotably secured to said headboard pair of legs, a first shaft fixedly secured to the ends thereof to said one end of said each of said first pair of arms, the other end of one of said first pair of arms slideably engaged within a first slot located in one of said pair of elongated side members, said first slot extending along the longitudinal axis of said one side member, first means to rotate said first shaft causing said first pair of arms to alter the angular relationship between said first pair of arms and said headboard pair of legs and causing said other end of said one of said first pair of arms to travel along the length of said first slot, and a second pair of arms, one end of each of said second pair of arms pivotably secured to said footboard pair of legs, a second shaft fixedly secured at the ends thereof to said one end of said each of said second pair of arms, the other end of one of said second pair of arms slideably engaged within a second slot located in said one side member, said second slot extending along the longitudinal axis of said one side member, second means to rotate said second shaft causing said second pair of arms to alter the angular relationship between said second pair of arms and said footboard pair of legs and causing said other end of said one of said second pair of arms to travel along the length of said second slot.

2. The improvement as claimed in claim 1 wherein said first rotation means and said second rotation means comprise a pair of electrically operated motors, the output shaft of one of said pair of motors rotatably coupled to said first shaft, the output shaft of the other of said pair of motors rotatably coupled to said second shaft.

3. The improvement as claimed in claim 2 further comprising means to selectively energize one of said pair of motors without energizing the other of said pair of motors.

4. The improvement as claimed in claim 2 further comprising means to concurrently energize said pair of motors.

5. The improvement as claimed in claim 1 wherein said slidable attaching means comprises four sleeves, each of said sleeves being fixedly secured adjacent the corners of said frame, one of the legs of said pairs of legs being slidably disposed within one of said sleeves.

6. The improvement as claimed in claim 1 further comprising a pair of wheels, each of said pair of wheels having an annular groove disposed radially inwardly from the material edge thereof, one of said pair of wheels located within said first slot; the other of said pair of wheels located within said second slot, said one wheel rotatably affixed to said other end of said one of said first pair of arms, said other wheel rotatably affixed to said other end of said one of said second pair of arms.

* * * * *